US008800513B2

(12) United States Patent
David et al.

(10) Patent No.: US 8,800,513 B2
(45) Date of Patent: Aug. 12, 2014

(54) AXIALLY COMPACT COUPLING FOR A CAMSHAFT PHASER ACTUATED BY ELECTRIC MOTOR

(75) Inventors: Pascal David, Beidweiler (LU); Pierre Kimus, Attert (BE)

(73) Assignee: Delphi Technologies, Inc., Troy, MI (US)

( * ) Notice: Subject to any disclaimer, the term of this patent is extended or adjusted under 35 U.S.C. 154(b) by 389 days.

(21) Appl. No.: 13/112,199

(22) Filed: May 20, 2011

(65) Prior Publication Data

US 2012/0291729 A1 Nov. 22, 2012

(51) Int. Cl.
*F01L 1/34* (2006.01)

(52) U.S. Cl.
USPC ..... 123/90.17

(58) Field of Classification Search
USPC ..... 123/90.15, 90.17; 464/103–105, 152, 464/72–73, 137, 138
See application file for complete search history.

(56) References Cited

U.S. PATENT DOCUMENTS

| | | | | | |
|---|---|---|---|---|---|
| 1,417,432 | A * | 5/1922 | Walker | 464/73 |
| 1,663,629 | A * | 3/1928 | Fritzsching | 384/497 |
| 1,669,931 | A * | 5/1928 | Dowrie | 464/102 |
| 2,011,147 | A * | 8/1935 | Haselau | 464/104 |
| 2,720,765 | A * | 10/1955 | Drexler | 464/41 |
| 2,841,967 | A * | 7/1958 | Baker | 464/73 |
| 2,943,464 | A * | 7/1960 | Voges | 464/73 |
| 3,217,517 | A * | 11/1965 | Warnery | 464/33 |
| 3,606,768 | A * | 9/1971 | Wildhaber | 464/103 |
| 5,417,186 | A | 5/1995 | Elrod et al. | |
| 6,257,186 | B1 | 7/2001 | Heer | |
| 6,328,006 | B1 | 12/2001 | Heer | |
| 6,981,478 | B2 * | 1/2006 | Schafer et al. | 123/90.17 |
| 7,308,876 | B2 * | 12/2007 | Schafer et al. | 123/90.17 |
| 7,421,990 | B2 * | 9/2008 | Taye et al. | 123/90.17 |
| 7,444,968 | B2 * | 11/2008 | Lancefield et al. | 123/90.17 |
| 7,763,336 | B2 * | 7/2010 | Clarke et al. | 428/36.9 |
| 7,779,800 | B2 * | 8/2010 | Methley et al. | 123/90.17 |
| 7,802,548 | B2 * | 9/2010 | Gregor et al. | 123/90.17 |
| 7,886,704 | B2 * | 2/2011 | Friedrichs | 123/90.17 |
| 2003/0226532 | A1 * | 12/2003 | Takenaka et al. | 123/90.17 |
| 2005/0199201 | A1 * | 9/2005 | Schafer et al. | 123/90.17 |
| 2006/0201462 | A1 * | 9/2006 | Schafer et al. | 123/90.17 |
| 2009/0013948 | A1 * | 1/2009 | Friedrichs | 123/90.17 |
| 2010/0144452 | A1 * | 6/2010 | Muenich et al. | 464/105 |
| 2011/0030631 | A1 | 2/2011 | David et al. | |
| 2011/0030632 | A1 | 2/2011 | David et al. | |
| 2012/0291729 | A1 * | 11/2012 | David et al. | 123/90.15 |
| 2013/0081587 | A1 * | 4/2013 | David et al. | 123/90.17 |

* cited by examiner

*Primary Examiner* — Thomas Denion
*Assistant Examiner* — Steven D Shipe
(74) *Attorney, Agent, or Firm* — Thomas N. Twomey

(57) ABSTRACT

A camshaft phaser includes a housing with a harmonic gear drive unit disposed therein. The harmonic gear drive unit includes a circular spline and a dynamic spline, a flexspline disposed within the circular spline and the dynamic spline, a wave generator disposed within the flexspline, and a rotational actuator connectable to the wave generator. A coupling adapter is disposed coaxially within the housing bore and fixed to the wave generator and supported in the housing by a bearing which is press fit onto a bearing surface of the coupling adapter. The coupling adapter has a coupling adapter bore with opposing drive lugs extending radially inward therefrom which are axially coincident with the bearing surface. A coupling of the rotational actuator is disposed within the coupling adapter bore and has opposing drive slots which receive the opposing drive lugs, thereby transmitting motion from the coupling to the coupling adapter.

12 Claims, 5 Drawing Sheets

AXIALLY COMPACT COUPLING FOR A CAMSHAFT PHASER ACTUATED BY ELECTRIC MOTOR

TECHNICAL FIELD OF INVENTION

The present invention relates to an electric variable camshaft phaser (eVCP) which uses an electric motor to actuate a gear drive unit of the eVCP to vary the phase relationship between a crankshaft and a camshaft in an internal combustion engine; more particularly to such a camshaft phaser which includes a harmonic gear drive unit as the gear drive unit; even more particularly, to an eVCP with an axially compact coupling for connecting the electric motor to a gear drive unit of the eVCP; and still even more particularly to such a coupling which allows for misalignment between the rotational axis of the electric motor and the rotational axis of an input gear member of the gear drive unit.

BACKGROUND OF INVENTION

Camshaft phasers for varying the timing of combustion valves in internal combustion engines are well known. A first element, known generally as a sprocket element, is driven by a chain, belt, or gearing from the internal combustion engine's crankshaft. A second element, known generally as a camshaft plate, is mounted to the end of an internal combustion engine's camshaft. A common type of camshaft phaser used by motor vehicle manufactures is known as a vane-type camshaft phaser. U.S. Pat. No. 7,421,989 shows a typical vane-type camshaft phaser which generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve, in accordance with an engine control module, to either the advance or retard chambers, to change the angular position of the rotor relative to the stator, and consequently the angular position of the camshaft relative to the crankshaft, as required to meet current or anticipated engine operating conditions.

While vane-type camshaft phasers are effective and relatively inexpensive, they do suffer from drawbacks. First, at low engine speeds, oil pressure tends to be low, and sometimes unacceptable. Therefore, the response of a vane-type camshaft phaser may be slow at low engine speeds. Second, at low environmental temperatures, and especially at engine start-up, engine oil displays a relatively high viscosity and is more difficult to pump, therefore making it more difficult to quickly supply engine oil to the vane-type camshaft phaser. Third, using engine oil to drive the vane-type camshaft phaser is parasitic on the engine oil system and can lead to requirement of a larger oil pump. Fourth, for fast actuation, a larger engine oil pump may be necessary, resulting in additional fuel consumption by the internal combustion engine. Lastly, the total amount of phase authority provided by vane-type camshaft phasers is limited by the amount of space between adjacent vanes and lobes. A greater amount of phase authority may be desired than is capable of being provided between adjacent vanes and lobes. For at least these reasons, the automotive industry is developing electrically driven camshaft phasers. Electrically driven camshaft phasers include a gear drive unit having an input gear member and an output gear member. Rotation of the input gear member by the electric motor causes relative rotation between the input gear member and the output gear and consequently a change in phase relationship between the crankshaft and the camshaft.

One type of electrically driven camshaft phaser being developed uses a harmonic drive gear unit, actuated by an electric motor, to change the angular position of the camshaft relative to the crankshaft. Examples of such camshaft phasers are shown in U.S. Pat. Nos. 5,417,186; 6,328,006; 6,257,186 and 7,421,990. In each of these examples, an electric motor includes a motor shaft which is coupled to an input member of the harmonic gear drive unit by inserting the motor shaft within a bore of the input member. The motor shaft is prevented from rotating relative to the harmonic drive input member by pinning the shaft to the input member or by using a key and keyway. While these attachment methods are simple, they does not allow for misalignment of the motor shaft and the bore of the input member of the harmonic drive gear unit.

United States Patent Application Publication No. US 2011/0030631 A1, which is assigned to Applicant and incorporated herein by reference in its entirety, also teaches an electrically driven camshaft phaser using a harmonic drive gear unit, actuated by an electric motor, to change the angular position of the camshaft relative to the crankshaft. However, unlike the previous examples, the electric motor includes a coupling pinned to its motor shaft. The coupling includes opposing male drive lugs which interfit with female drive slots formed in a coupling adapter which is attached to the input of the harmonic gear drive unit. The female drive slots are formed in a portion of the coupling adapter which extends axially away from/axially adjacent to a press fit surface of the coupling adapter. The press fit surface receives a bearing in a press fit manner to radially support the coupling adapter within a housing. It may be undesirable to position the female drive slots radially under the press fit surface to decrease the axial length because doing so may compromise the bearing press fit. Consequently, the axial length of the camshaft phaser is lengthened due to the need for the female drive slots to be positioned axially away from the bearing press fit area.

What is needed is an electrically driven camshaft phaser with an axially compact coupling for joining an electric motor to a gear drive unit; more particularly to such a camshaft phaser in which the gear drive unit is a harmonic gear drive unit; and even more particularly to such a camshaft phaser in which the coupling adapter allows for misalignment between the axis of rotation of the electric motor and the axis of rotation of an input gear member of the gear drive unit.

SUMMARY OF THE INVENTION

Briefly described, a camshaft phaser is provided for controllably varying the phase relationship between a crankshaft and a camshaft in an internal combustion engine. The camshaft phaser includes a housing having a bore with a longitudinal axis and a harmonic gear drive unit is disposed therein. The harmonic gear drive unit includes a circular spline and a dynamic spline, a flexspline disposed within the circular spline and the dynamic spline, a wave generator disposed within the flexspline, and a rotational actuator connectable to the wave generator. One of the circular spline and the dynamic spline is fixed to the housing in order to prevent relative rotation therebetween. A hub is rotatably disposed within the housing and attachable to the camshaft and fixed to the other of the circular spline and the dynamic spline in order to prevent relative rotation therebetween. A coupling adapter disposed coaxially within the housing bore is fixed to the wave generator and supported in the housing by a bearing which is press fit onto a bearing surface of the coupling adapter. The coupling adapter has a coupling adapter bore with opposing drive lugs extending radially inward therefrom which are axially coincident with the bearing surface. A coupling is fixed to a shaft of the rotational actuator having a shaft longitudinal axis. The coupling is disposed within the coupling adapter bore and has opposing drive slots for receiving the opposing drive lugs for transmitting rotary motion from the coupling to the coupling adapter.

BRIEF DESCRIPTION OF DRAWINGS

This invention will be further described with reference to the accompanying drawings in which.

DETAILED DESCRIPTION OF INVENTION

Figure 1:
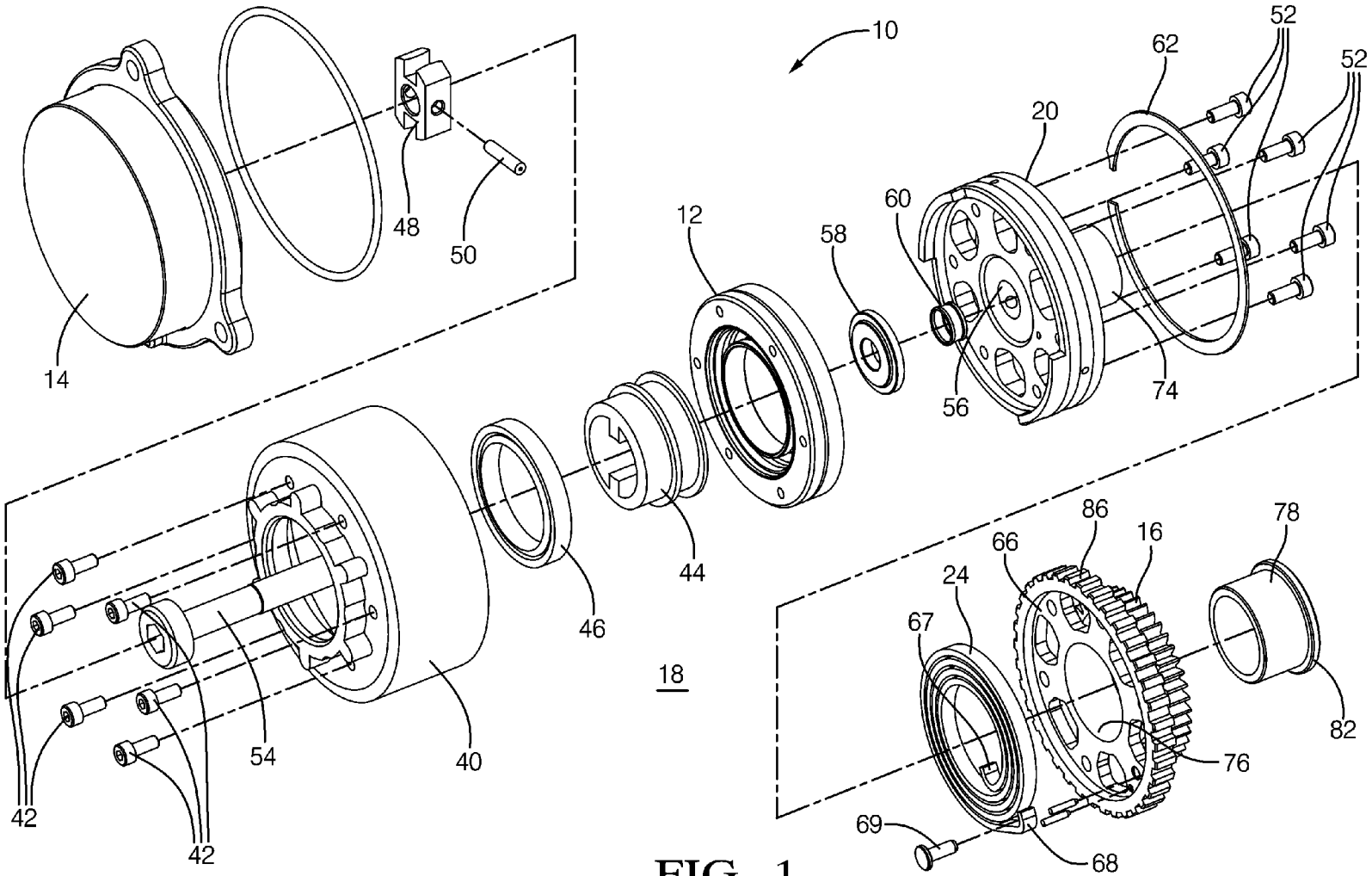
FIG. 1 is an exploded isometric view of an eVCP in accordance with the present invention.
Figure 2:
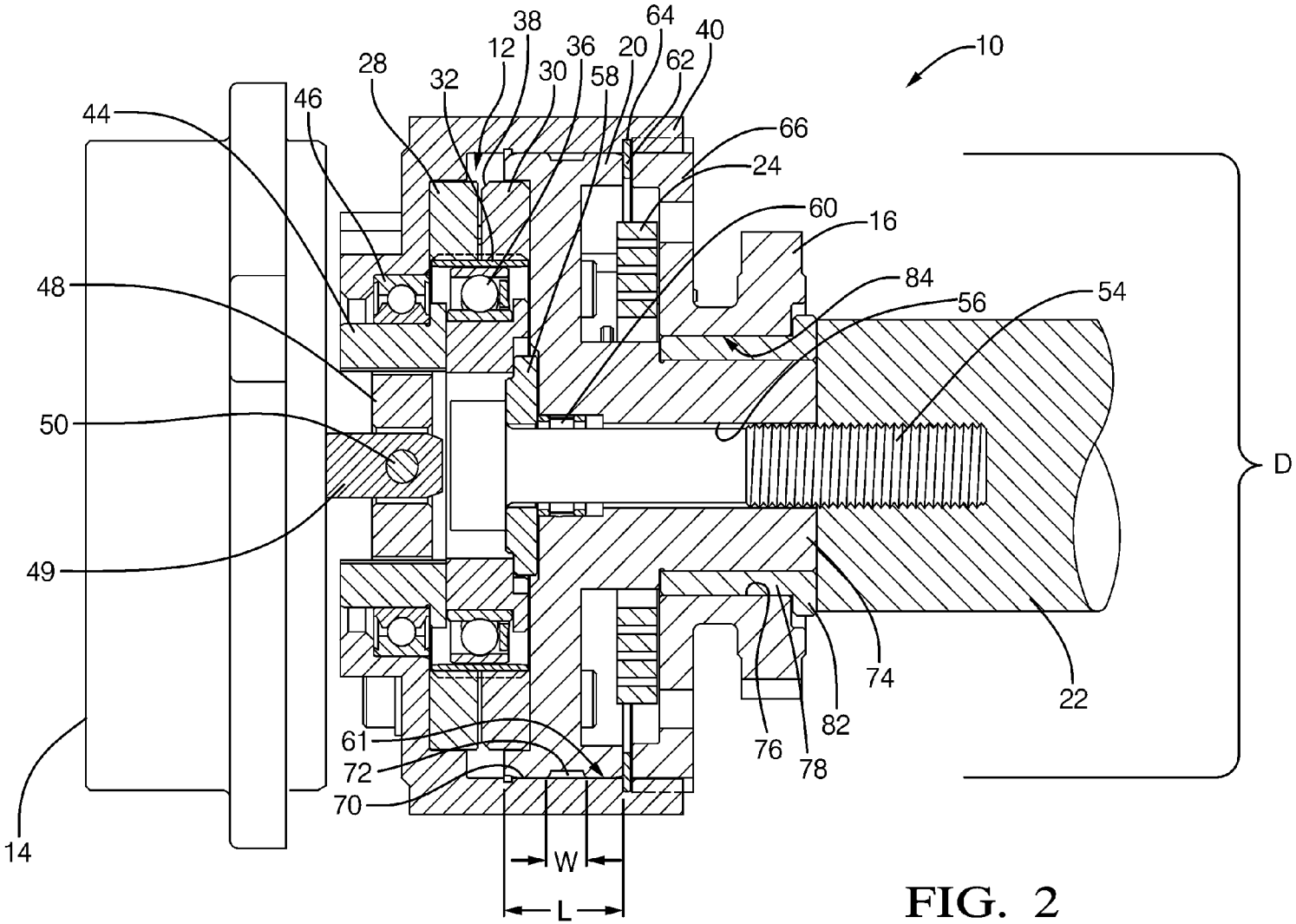
FIG. 2 is an axial cross-section of an eVCP in accordance with the present invention.

Referring to FIGS. 1 and 2, eVCP 10 in accordance with the present invention comprises flat harmonic gear drive unit 12; rotational actuator 14 that may be a hydraulic motor but is preferably a DC electric motor, operationally connected to harmonic gear drive unit 12; input sprocket 16 operationally connected to harmonic gear drive unit 12 and drivable by a crankshaft (not shown) of internal combustion engine 18; output hub 20 attached to harmonic gear drive unit 12 and mountable to an end of camshaft 22 of internal combustion engine 18; and bias spring 24 operationally disposed between output hub 20 and input sprocket 16. Electric motor 14 may be an axial-flux DC motor.

Harmonic gear drive unit 12 comprises an outer first spline 28 which may be either a circular spline or a dynamic spline as described below; an outer second spline 30 which is the opposite (dynamic or circular) of first spline 28 and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32.

Flexspline 32 is a non-rigid ring with external teeth on a slightly smaller pitch diameter than the circular spline. It is fitted over and elastically deflected by wave generator 36.

The circular spline is a rigid ring with internal teeth engaging the teeth of flexspline 32 across the major axis of wave generator 36.

The dynamic spline is a rigid ring having internal teeth of the same number as flexspline 32. It rotates together with flexspline 32 and serves as the output member. Either the dynamic spline or the circular spline may be identified by a chamfered corner 38 at its outside diameter to distinguish one spline from the other.

As is disclosed in the prior art, wave generator 36 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of harmonic gear drive unit 12, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 12 is thus a high-ratio gear transmission; that is, the angular phase relationship between first spline 28 and second spline 30 changes by 2% for every revolution of wave generator 36.

Of course, as will be obvious to those skilled in the art, the circular spline rather may have slightly more teeth than the dynamic spline has, in which case the rotational relationships described below are reversed.

Still referring to FIGS. 1 and 2, input sprocket 16 is rotationally fixed to a generally cup-shaped sprocket housing 40 that is fastened by bolts 42 to first spline 28. Coupling adaptor 44 is mounted to wave generator 36 and extends through sprocket housing 40, being supported by bearing 46 mounted in sprocket housing 40. Coupling adapter 44 rotates about coupling adapter rotational axis 47. Coupling 48 is mounted to motor shaft 49 of electric motor 14 and retained thereto by pin 50 engages coupling adaptor 44, permitting wave generator 36 to be rotationally driven by electric motor 14, as may be desired to alter the phase relationship between first spline 28 and second spline 30. Motor shaft 49 is rotatable about rotational actuator rotational axis 51. Coupling adapter 44, coupling 48, and motor shaft 49 will be described in more detail later.

Output hub 20 is fastened to second spline 30 by bolts 52 and may be secured to camshaft 22 by camshaft phaser attachment bolt 54 extending through output hub axial bore 56 in output hub 20, and capturing stepped thrust washer 58 and filter 60 recessed in output hub 20. In an eVCP, it is necessary to limit radial run-out between the input hub and output hub. In the prior art, this has been done by providing multiple roller bearings to maintain concentricity between the input and output hubs. Referring to FIG. 2, radial run-out is limited by a single journal bearing interface 61 between sprocket housing 40 (input hub) and output hub 20, thereby reducing the overall axial length of eVCP 10 and its cost to manufacture. Output hub 20 is retained within sprocket housing 40 by snap ring 62 disposed in an annular groove 64 formed in sprocket housing 40.

Back plate 66, which is integrally formed with input sprocket 16, captures bias spring 24 against output hub 20. Inner spring tang 67 is engaged by output hub 20, and outer spring tang 68 is attached to back plate 66 by pin 69. In the event of an electric motor malfunction, bias spring 24 is biased to back-drive harmonic gear drive unit 12 without help from electric motor 14 to a rotational position of second spline 30 wherein internal combustion engine 18 will start or run, which position may be at one of the extreme ends of the range of authority or intermediate of the phaser's extreme ends of its rotational range of authority. For example, the rotational range of travel in which bias spring 24 biases harmonic gear drive unit 12 may be limited to something short of the end stop position of the phaser's range of authority. Such an arrangement would be useful for internal combustion engines requiring an intermediate park position for idle or restart.

The nominal diameter of output hub 20 is D; the nominal axial length of first journal bearing 70 is L; and the nominal axial length of the oil groove 72 formed in either output hub 20 (shown) and/or in sprocket housing 40 (not shown) for supplying oil to first journal bearing 70 is W. In addition to journal bearing clearance, the length L of the journal bearing in relation to output hub diameter D controls how much output hub 20 can tip within sprocket housing 40. The width of oil groove 72 in relation to journal bearing length L controls how much bearing contact area is available to carry the radial load. Experimentation has shown that a currently preferred range of the ratio L/D may be between about 0.25 and about 0.40, and that a currently preferred range of the ratio W/L may be between about 0.15 and about 0.70.

Extension portion 74 of output hub 20 receives bushing 78 in a press fit manner. In this way, output hub 20 is fixed to bushing 78. Input sprocket axial bore 76 interfaces in a sliding fit manner with bushing 78 to form second journal bearing 84. This provides support for the radial drive load placed on input sprocket 16 and prevents the radial drive load from tipping first journal bearing 70 which could cause binding and wear issues for first journal bearing 70. Bushing 78 includes radial flange 82 which serves to axially retain back plate 66/input sprocket 16. Alternatively, but not shown, bushing 78 may be eliminated and input sprocket axial bore 76 could interface in a sliding fit manner with extension portion 74 of output hub 20 to form second journal bearing 84 and thereby provide the support for the radial drive load placed on input sprocket 16. In this alternative, back plate 66/input sprocket 16 may be axially retained by a snap ring (not shown) received in a groove (not shown) of extension portion 74.

Figure 3:
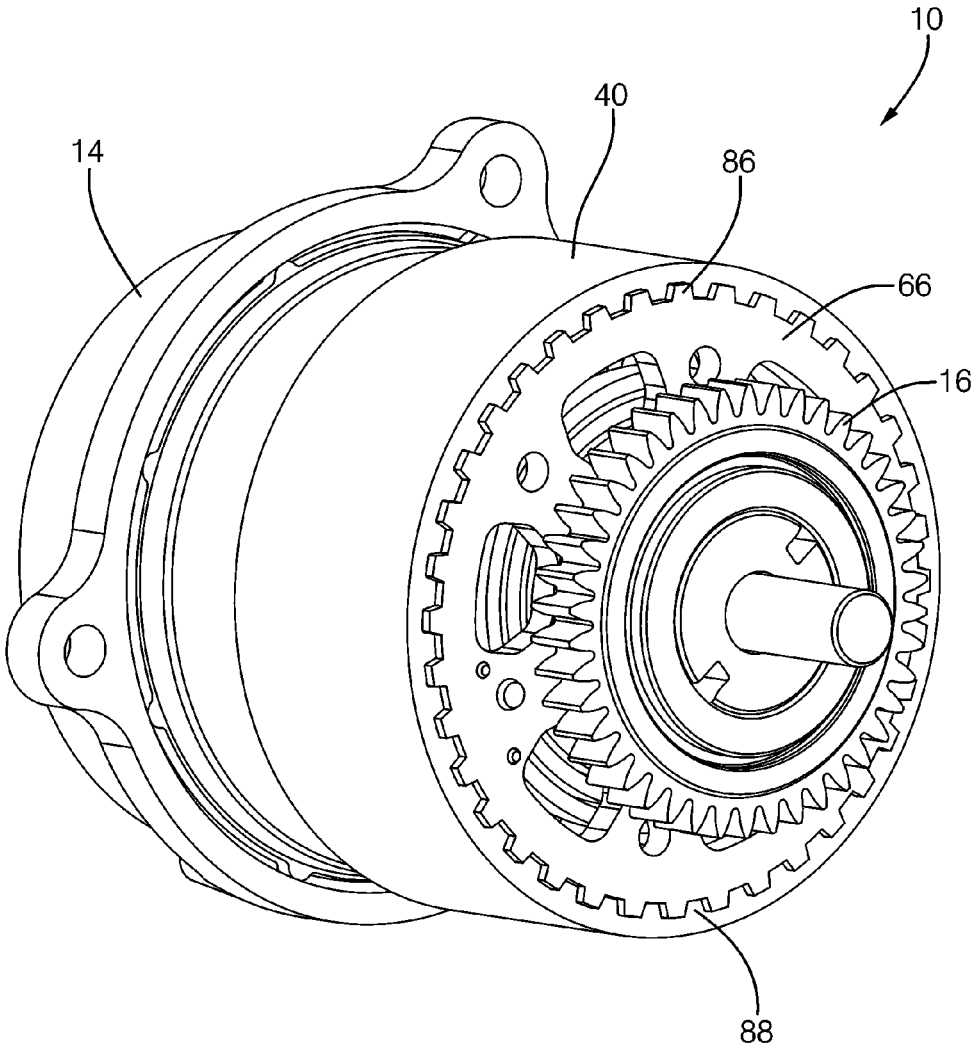
FIG. 3 is an isometric view of an eVCP in accordance with the present invention.
Figure 4:
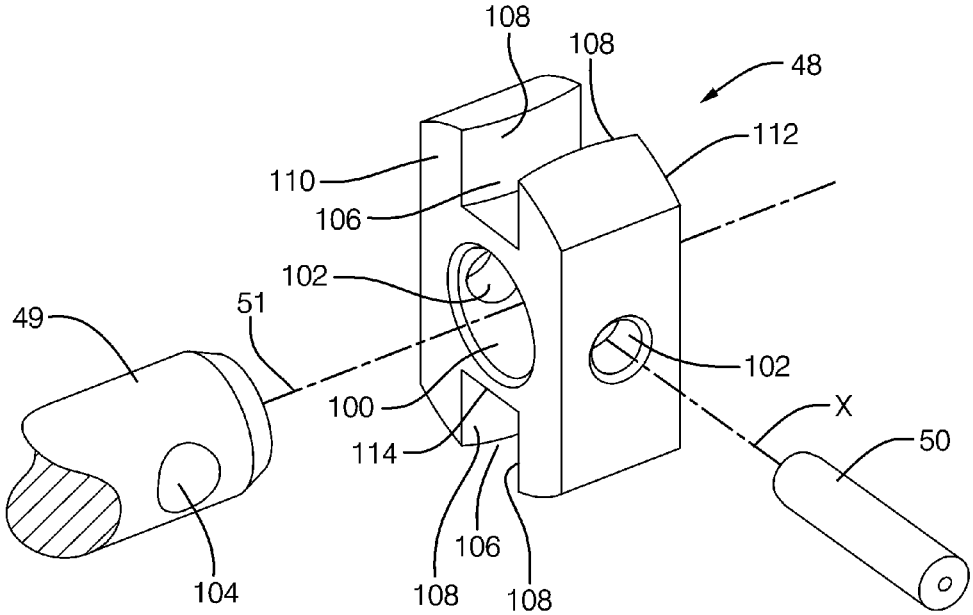
FIG. 4 is an enlarged elevation view of a coupling and coupling adapter in accordance with the present invention showing the linear misalignment permitted between the coupling and coupling adapter.
Figure 5:
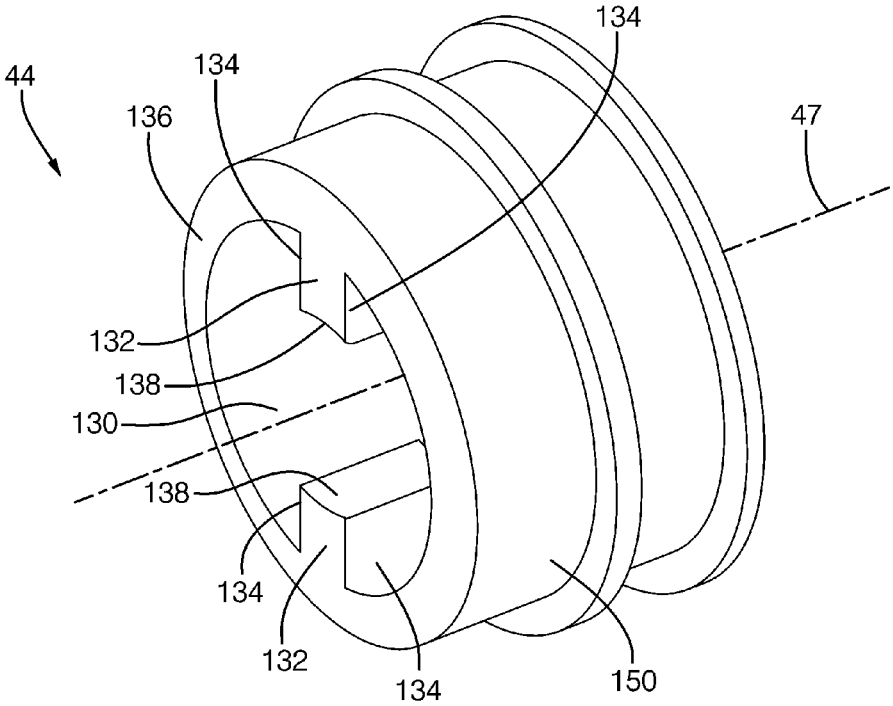
FIG. 5 is an enlarged isometric view a coupling of FIG. 1.

In order to transmit torque from input sprocket 16/back plate 66 to sprocket housing 40 and referring to FIGS. 1-3, a sleeve gear type joint is used in which back plate 66 includes external splines 86 which slidingly fit with internal splines 88 included within sprocket housing 40. The sliding fit nature of the splines 86, 88 eliminates or significantly reduces the radial tolerance stack issue between first journal bearing 70 and second journal bearing 84 because the two journal bearings 70, 84 operate independently and do not transfer load from one to the other. If this tolerance stack issue were not resolved, manufacture of the two journal bearings would be prohibitive in mass production because of component size and concentricity tolerances that would need to be maintained. The sleeve gear arrangement also eliminates then need for a bolted flange arrangement to rotationally fix back plate 66 to sprocket housing 40 which minimizes size and mass. Additionally, splines 86, 88 lend themselves to fabrication methods where they can be net formed onto back plate 66 and into sprocket housing 40 respectively. Splines 86, 88 may be made, for example, by powder metal process or by standard gear cutting methods.

Coupling adapter 44 and coupling 48 are provided with features that provide axial compactness and tolerance to misalignment of rotational actuator rotational axis 51 to coupling adapter rotational axis 47. These features will now be described with reference to FIGS. 1, 2, and 4-7. As mentioned previously, coupling 48 is mounted to motor shaft 49 of electric motor 14. This is accomplished by inserting motor shaft 49 into receiving bore 100 which extends through coupling 48 and which is sized to provide radial clearance with motor shaft 49. In order to provide misalignment between the rotational actuator rotational axis 51 of electric motor 14 and coupling adapter rotational axis 47 along a misalignment axis shown as axis X in FIG. 6, pin 50 is press fit within opposing coupling pin bores 102 which are substantially perpendicular to receiving bore 100 and rotational actuator rotational axis 51 while pin 50 passes through motor shaft pin bore 104 of motor shaft 49 in a close sliding fit. Axis X is substantially perpendicular to rotational actuator rotational axis 51. The close sliding fit of pin 50 with motor shaft pin bore 104 allows substantially uninhibited linear movement of motor shaft 49 along pin 50 along axis X while substantially preventing lash in the form of rotation of motor shaft 49 relative to pin 50 about rotational actuator rotational axis 51. In addition to allowing uninhibited linear movement of motor shaft 49 along pin 50 along axis X, the close sliding fit of pin 50 with motor shaft pin bore 104 and the radial clearance between motor shaft 49 and receiving bore 100 allows angular misalignment of motor shaft 49 to coupling 48 by allowing motor shaft 49 to pivot about pin 50, thereby allowing motor shaft 49 to articulate with respect to coupling 44 about axis X. Alternatively, pin 50 may be press fit within motor shaft pin bore 104 while pin 50 passes through coupling pin bores 102 in a close sliding fit to provide the same misalignment qualities.

Coupling 48 is provided with opposing drive slots 106 which extend thereinto from the outside circumference thereof. Each drive slot 106 is defined by opposing slot sidewalls 108 which extend from front coupling surface 110 of coupling 48 to rear coupling surface 112 of coupling 48. Slot sidewalls 108 are substantially perpendicular to pin 50. Opposing slot sidewalls 108 of each drive slot 106 are connected by floor 114 which extends from front coupling surface 110 to rear coupling surface 112. Each slot sidewall 108 may be crowned from front coupling surface 110 to rear coupling surface 112 toward its opposing slot sidewall 108. The function of the crowned nature of slot sidewalls 108 will be discussed in more detail later.

Coupling adapter 44 includes coupling adapter bore 130 for receiving coupling 48 therein. Coupling adapter bore 130 includes opposing drive lugs 132 extending radially inward which are sized to interfit with drive slots 106 of coupling 48 in a close sliding fit to prevent relative rotation between coupling 48 and coupling adapter 44 about coupling adapter rotational axis 47 when coupling 48 is rotated by electric motor 14. Each drive lug 132 is defined by opposing lug sidewalls 134 which are substantially planar and parallel to each other and which extend axially from front coupling adapter surface 136 at least part way into coupling adapter bore 130. Opposing lug sidewalls 134 are terminated by radial surface 138 which may be concave from one lug sidewall 134 to its opposing lug sidewall 134 as shown or may alternatively be substantially planar (not shown).

Figure 6:
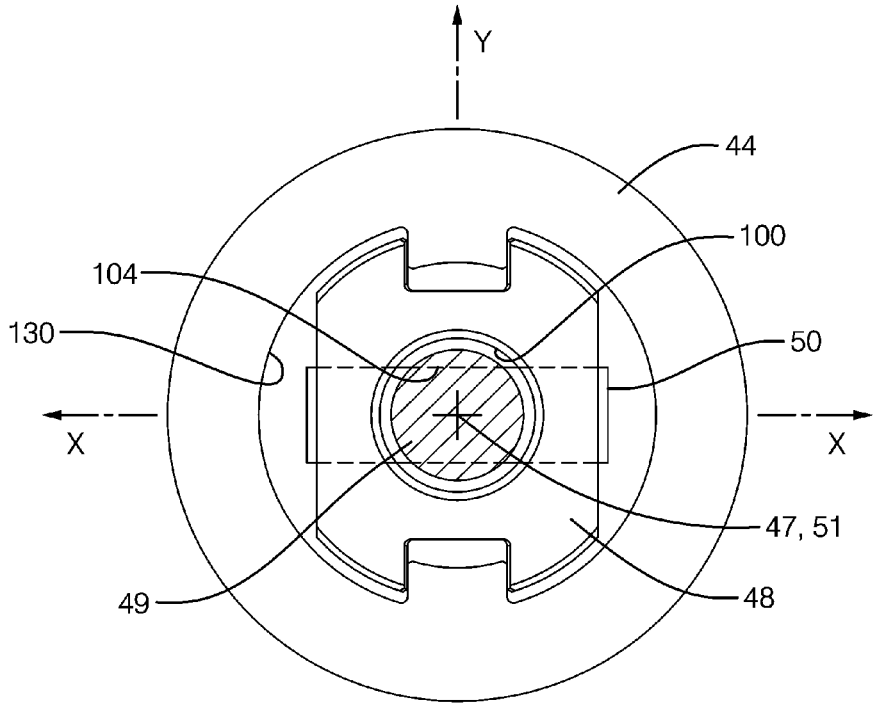
FIG. 6 is an enlarged isometric view of a coupling adapter of FIG. 1.
Figure 7:
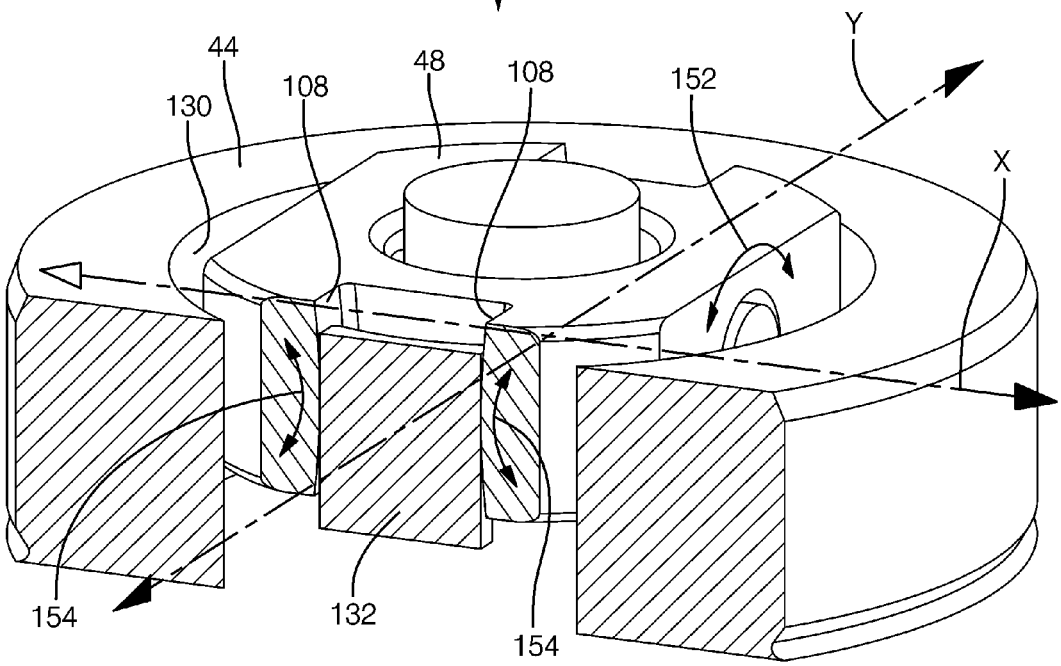
FIG. 7 is an enlarged isometric view of the coupling of FIG. 5 within the coupling adapter of FIG. 6 showing the angular misalignment permitted between the coupling and coupling adapter.

In order to provide misalignment between rotational actuator rotational axis 51 and coupling adapter rotational axis 47 along a misalignment axis shown as axis Y in FIG. 6, drive slots 106 and drive lugs 132 are sized to provide radial clearance therebetween along axis Y. Axis Y is substantially perpendicular to axis X. Also in order to provide misalignment between rotational actuator rotational axis 51 and coupling adapter rotational axis 47 along axis Y as shown in FIG. 6, coupling adapter 44 and coupling adapter bore 130 are sized to provide radial clearance therebetween along axis Y.

In addition to misalignment between rotational actuator rotational axis 51 and coupling adapter rotational axis 47 along axes X and Y, angular misalignment between rotational actuator rotational axis 51 and coupling adapter rotational axis 47 is also provided. Articulation, or angular misalignment, between coupling 48 and coupling adapter 44 about axis X is provided by the same features of coupling 48 and coupling adapter 44 which allow misalignment along axis Y as discussed previously. This articulation, or angular misalignment, is shown by arrows 152 in FIG. 7. Articulation between coupling 48 and coupling adapter 44 about axis Y is provided by the inward crowning of opposing slot sidewalls 108 and the clearance provided between the outer periphery of coupling 44 and coupling adapter bore 130. This articulation, or angular misalignment, is shown by arrows 154 in FIG. 7. Alternatively, but no shown, slot sidewalls 108 could be substantially planar and parallel to each other while lug sidewalls 134 could be crowned outward to allow articulation between coupling 48 and coupling adapter 44 about axis Y.

Bearing 46 is press fit onto bearing surface 150 of coupling adapter 44. Bearing surface 150 circumferentially surrounds drive lugs 132 such that drive lugs 132 are axially coincident with bearing 46. Positioning drive lugs 132 axially coincident with bearing 46 allows coupling 48 to extend axially further into coupling adapter bore 130, thereby allowing eVCP 10 to be more axially compact. In previous arrangements, the drive slots have been placed in the coupling adapter. In order to not weaken the bearing surface and maintain the integrity of the press fit between the bearing and the coupling adapter, the drive slots needed to be axially adjacent to the bearing press surface rather than being axially coincident with the bearing press surface, thereby axially extending the entire eVCP package.

While the embodiment described herein describes input sprocket 16 as being smaller in diameter than sprocket housing 40 and disposed axially behind sprocket housing 40, it should now be understood that the input sprocket may be radially surrounding the sprocket housing and axially aligned therewith. In this example, the back plate may be press fit into the sprocket housing rather than having a sleeve gear type joint.

The embodiment described herein describes harmonic gear drive unit 12 as comprising outer first spline 28 which may be either a circular spline or a dynamic spline which serves as the input member; an outer second spline 30 which is the opposite (dynamic or circular) of first spline 28 and which serves as the output member and is coaxially positioned adjacent first spline 28; a flexspline 32 disposed radially inwards of both first and second splines 28, 30 and having outwardly-extending gear teeth disposed for engaging inwardly-extending gear teeth on both first and second splines 28, 30; and a wave generator 36 disposed radially inwards of and engaging flexspline 32. As described, harmonic gear drive unit 12 is a flat plate or pancake type harmonic gear drive unit as referred to in the art. However, it should now be understood that other types of harmonic gear drive units may be used in accordance with the present invention. For example, a cup type harmonic gear drive unit may be used. The cup type harmonic gear drive unit comprises a circular spline which serves as the input member; a flexspline which serves as the output member and which is disposed radially inwards of the circular spline and having outwardly-extending gear teeth disposed for engaging inwardly-extending gear teeth on the circular spline; and a wave generator disposed radially inwards of and engaging the flexspline.

While the embodiment described herein has been described in terms of using a harmonic gear drive unit, it should now be understood that other gear drive units may be used within the scope of this invention. Some examples of other gear drive units may include, but are not limited to, spur gears, helical gears, hypoid gears, worm gears, and planetary gears. Generically, a motor shaft of an electric motor is attached to an input gear member of the gear drive unit through a coupling attached to the motor shaft and a coupling adapter attached to the input gear member. Rotation of the input gear member by the electric motor results in relative rotation between the input gear member and an output gear member of the gear drive unit which is connected to the camshaft of the engine. As a result, the camshaft is rotated relative to the crankshaft of the engine.

While the invention has been described by reference to various specific embodiments, it should be understood that numerous changes may be made within the spirit and scope of the inventive concepts described. Accordingly, it is intended that the invention not be limited to the described embodiments, but rather only to the extent set forth in the claims that follow.

We claim:

1. A camshaft phaser for controllably varying the phase relationship between a crankshaft and a camshaft in an internal combustion engine, said camshaft phaser comprising:

a housing having a housing bore with a longitudinal axis;

a harmonic gear drive unit disposed within said housing, said harmonic gear drive unit comprising a circular spline and an axially adjacent dynamic spline, a flexspline disposed within said circular spline and said dynamic spline, a wave generator disposed within said flexspline, and a rotational actuator connectable to said wave generator such that rotation of said wave generator causes relative rotation between said circular spline and said dynamic spline, wherein one of said circular spline and said dynamic spline is fixed to said housing in order to prevent relative rotation therebetween;

a hub rotatably disposed within said housing axially adjacent to said harmonic gear drive unit and attachable to said camshaft and fixed to the other of said circular spline and said dynamic spline in order to prevent relative rotation therebetween;

a coupling adapter coaxial with said housing bore and fixed to said wave generator, said coupling adapter being rotatable about a coupling adapter rotational axis and being supported in said housing by a bearing which is press fit onto a bearing surface of said coupling adapter, said coupling adapter having a coupling adapter bore with opposing drive lugs extending radially inward therefrom which are axially coincident with said bearing surface; and a coupling fixed to a shaft of said rotational actuator, said shaft being rotatable about a rotational actuator rotational axis, said coupling being disposed within said coupling adapter bore and having opposing drive slots for receiving said opposing drive lugs, thereby transmitting rotary motion from said coupling to said coupling adapter;

wherein said coupling is sized to allow linear movement of said coupling within said coupling adapter bore along a first misalignment axis that is substantially perpendicular to said coupling adapter rotational axis wherein each of said opposing drive lugs includes opposing lug sidewalls that extend axially and are substantially parallel to each other.

2. A camshaft phaser as in claim 1 wherein each of said drive slots includes opposing slot sidewalls that are crowned toward each other for allowing articulation between said coupling and said coupling adapter about said first misalignment axis.

3. A camshaft phaser as in claim 2 wherein said shaft is disposed within a receiving bore of said coupling and retained therein by a pin which is substantially perpendicular to said rotational actuator rotational axis and which is received within opposing coupling pin bores of said coupling and within a shaft pin bore of said shaft.

4. A camshaft phaser as in claim 3 wherein said pin is press fit within one of said shaft pin bore and said coupling pin bores and is in a close sliding fit within the other of said shaft pin bore and said coupling pin bores and wherein said shaft is sized to provide radial clearance with said receiving bore for allowing articulation between said coupling and said coupling adapter about a second misalignment axis which is substantially perpendicular to said rotational actuator rotational axis and said first misalignment axis and also thereby allowing linear movement of said coupling within said coupling adapter along said second misalignment axis.

5. A camshaft phaser for controllably varying the phase relationship between a crankshaft and a camshaft in an internal combustion engine, said camshaft phaser comprising:

a housing having a housing bore with a longitudinal axis;

a harmonic gear drive unit including an input member, an output member, a wave generator disposed within said input member and said output member, and a rotational actuator connected to said wave generator such that rotation of said wave generator causes relative rotation between said input member and said output member;

a coupling adapter coaxial with said housing bore and fixed to said wave generator, said coupling adapter being rotatable about a coupling adapter rotational axis and being supported in said housing by a bearing which is press fit onto a bearing surface of said coupling adapter, said coupling adapter having a coupling adapter bore with opposing drive lugs extending radially inward therefrom which are axially coincident with said bearing surface; and a coupling fixed to a shaft of said rotational actuator, said shaft being rotatable about a rotational actuator rotational axis, said coupling being disposed within said coupling adapter bore and having opposing drive slots for receiving said opposing drive lugs, thereby transmitting rotary motion from said coupling to said coupling adapter;

wherein said coupling is sized to allow linear movement of said coupling within said coupling adapter bore along a first misalignment axis that is substantially perpendicular to said coupling adapter rotational axis wherein each of said opposing drive lugs includes opposing lug sidewalls that extend axially and are substantially parallel to each other.

6. A camshaft phaser as in claim 5 wherein each of said drive slots includes opposing slot sidewalls that are crowned toward each other for allowing articulation between said coupling and said coupling adapter about said first misalignment axis.

7. A camshaft phaser as in claim 6 wherein said shaft is disposed within a receiving bore of said coupling and retained therein by a pin which is substantially perpendicular to said rotational actuator rotational axis and which is received within opposing coupling pin bores of said coupling and within a shaft pin bore of said shaft.

8. A camshaft phaser as in claim 7 wherein said pin is press fit within one of said shaft pin bore and said coupling pin bores and is in a close sliding fit within the other of said shaft pin bore and said coupling pin bores and wherein said shaft is sized to provide radial clearance with said receiving bore for allowing articulation between said coupling and said coupling adapter about a second misalignment axis which is substantially perpendicular to said rotational actuator rotational axis and said first misalignment axis and also thereby allowing linear movement of said coupling within said coupling adapter along said second misalignment axis.

9. A camshaft phaser for controllably varying the phase relationship between a crankshaft and a camshaft in an internal combustion engine, said camshaft phaser comprising:

a housing having a housing bore with a longitudinal axis;

a gear drive unit disposed within said housing, said gear drive unit having an input gear member and an output gear member, the input gear member being attachable to said crankshaft and being attached to an output shaft of an electric motor, the output gear being attachable to said camshaft such that rotation of said input gear member by said electric motor causes relative rotation between said crankshaft and said camshaft;

a coupling adapter fixed to said input gear member, said coupling adapter being rotatable about a coupling adapter rotational axis and being supported in said housing by a bearing which is press fit onto a bearing surface of said coupling adapter, said coupling adapter having a coupling adapter bore with opposing drive lugs extending radially inward therefrom which are axially coincident with said bearing surface; and a coupling fixed to said output shaft of said electric motor, said output shaft being rotatable about a rotational actuator rotational axis, said coupling being disposed within said coupling adapter bore and having opposing drive slots for receiving said opposing drive lugs, thereby transmitting rotary motion from said coupling to said coupling adapter;

wherein said coupling is sized to allow linear movement of said coupling within said coupling adapter bore along a first misalignment axis that is substantially perpendicular to said coupling adapter rotational axis wherein each of said opposing drive lugs includes opposing lug sidewalls that extend axially and are substantially parallel to each other.

10. A camshaft phaser as in claim 9 wherein each of said drive slots includes opposing slot sidewalls that are crowned toward each other for allowing articulation between said coupling and said coupling adapter about said first misalignment axis.

11. A camshaft phaser as in claim 10 wherein said output shaft is disposed within a receiving bore of said coupling and retained therein by a pin which is substantially perpendicular to said rotational actuator rotational axis and which is received within opposing coupling pin bores of said coupling and within a shaft pin bore of said output shaft.

12. A camshaft phaser as in claim 11 wherein said pin is press fit within one of said shaft pin bore and said coupling pin bores and is in a close sliding fit within the other of said shaft pin bore and said coupling pin bores and wherein said output shaft is sized to provide radial clearance with said receiving bore for allowing articulation between said coupling and said coupling adapter about a second misalignment axis which is substantially perpendicular to said rotational actuator rotational axis and said first misalignment axis and also thereby allowing linear movement of said coupling within said coupling adapter along said second misalignment axis.

* * * * *